US011535995B2

(12) United States Patent
Barnes

(10) Patent No.: US 11,535,995 B2
(45) **Date of Patent: *Dec. 27, 2022**

(54) PILE GUIDE AND ADJUSTABLE MOUNTING

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 348 days.

This patent is subject to a terminal disclaimer.

(21) Appl. No.: 16/830,343

(22) Filed: Mar. 26, 2020

(65) Prior Publication Data

US 2020/0370261 A1 Nov. 26, 2020

Related U.S. Application Data

(60) Provisional application No. 62/851,783, filed on May 23, 2019.

(51) Int. Cl.

| | |
|---|---|
| ***B63C 1/02*** | (2006.01) |
| ***E02B 3/06*** | (2006.01) |
| ***E02B 3/28*** | (2006.01) |

(52) U.S. Cl.

CPC ..... *E02B 3/064* (2013.01); *B63C 1/02* (2013.01); *E02B 3/28* (2013.01)

(58) Field of Classification Search

CPC . E02D 13/04; B63C 1/02; E02B 3/064; E02B 3/066; E02B 3/068

USPC ..... 405/218–221

See application file for complete search history.

(56) References Cited

U.S. PATENT DOCUMENTS

| | | | | |
|---|---|---|---|---|
| 3,074,239 | A * | 1/1963 | Mustard | E02B 3/068 5/294 |
| 3,270,698 | A | 9/1966 | Fort | |
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,074,537 | A * | 2/1978 | Gronlie | E02B 3/068 52/645 |
| 4,212,564 | A * | 7/1980 | Kay | E02B 3/064 405/218 |
| 4,276,849 | A | 7/1981 | Bloxham | |
| 4,280,429 | A | 7/1981 | Wells | |

(Continued)

FOREIGN PATENT DOCUMENTS

| | | |
|---|---|---|
| DE | 2042850 | 3/1972 |
| FR | 3017595 | 6/2014 |
| WO | WO2014035026 | 3/2014 |

OTHER PUBLICATIONS https://www.jetdock.com (excerpt printed Jan. 29, 2020).

(Continued)

*Primary Examiner* — Frederick L Lagman
(74) *Attorney, Agent, or Firm* — B. Craig Killough

(57) ABSTRACT

A pile guide has a collar with a void therein. A planar flange extends from a side of the collar. A bracket has opposing guides constructed and arranged for receiving the planar flange of the pile guide therein. The planar flange is in a slidable relationship with the bracket, and the bracket is constructed and arranged for mounting to a floating dock. The distance of the collar from the floating dock can be adjusted to accommodate for distances of piles from the floating dock.

12 Claims, 3 Drawing Sheets

(56) References Cited

U.S. PATENT DOCUMENTS

| | | | | |
|---|---|---|---|---|
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |
| 5,002,000 | A | 3/1991 | Rutter | |
| 5,016,551 | A | 5/1991 | Peck et al. | |
| 5,046,897 | A | 9/1991 | Ray | |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 6,145,463 | A | 11/2000 | Zeilinger | |
| 6,179,525 | B1 | 1/2001 | Gruhn et al. | |
| 6,477,968 | B2 | 11/2002 | Powell | |
| 6,526,902 | B1 | 3/2003 | Faber | |
| 6,547,485 | B2 | 4/2003 | Elson | |
| 6,746,181 | B1 * | 6/2004 | Heintz | E02B 3/068 114/263 |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 | 4/2019 | Barnes et al. | |
| 10,370,073 | B2 | 8/2019 | Barnes | |
| D899,901 | S * | 10/2020 | Barnes | B63C 1/06 D8/382 |
| D899,903 | S * | 10/2020 | Barnes | E02B 3/064 D8/382 |
| 10,822,063 | B1 * | 11/2020 | Barnes | B63C 1/02 |
| 11,008,720 | B2 * | 5/2021 | Kirby | E02B 3/24 |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0248420 | A1 | 10/2007 | Jacobs et al. | |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2014/0010593 | A1 | 1/2014 | Davis | |
| 2019/0135390 | A1 * | 5/2019 | Barnes | B63C 1/06 |
| 2020/0115867 | A1 * | 4/2020 | Kirby | E02B 3/064 |
| 2021/0039761 | A1 * | 2/2021 | Barnes | B63C 1/02 |
| 2021/0214059 | A1 * | 7/2021 | Barnes | B63C 1/04 |

OTHER PUBLICATIONS

Shoremaster, LLC, Official RhinoHoist Front Mount Floating Boat Life Video, YouTube, May 10, 2013, https://www.youtube.com/watch7v-ayxgoTHCijl.

* cited by examiner

PILE GUIDE AND ADJUSTABLE MOUNTING

BACKGROUND OF THE INVENTION

Floating docks are used to provide dockage for vessels. Floating docks accommodate for changes in water levels by floating in water. Piles driven into the earth are used to hold the dock in horizontal position. Pile guides are affixed to the dock that allow vertical movement of the dock but prevent substantial horizontal movement of the dock.

Piles are typically not driven with precision. There is a need for a pile guide that can be adjusted to accommodate for the variable distance of the piles from the dock.

SUMMARY OF THE INVENTION

A pile guide has a collar with a void therein. A planar flange extends from a side of the collar. A bracket has opposing guides constructed and arranged for receiving the planar flange of the pile guide therein. The planar flange is in a slidable relationship with the bracket, and the bracket is constructed and arranged for mounting to a floating dock. The distance of the collar from the floating dock can be adjusted to accommodate for distances of piles from the floating dock.

BRIEF DRAWING DESCRIPTION

DETAILED DESCRIPTION OF PREFERRED EMBODIMENTS

Figure 1:
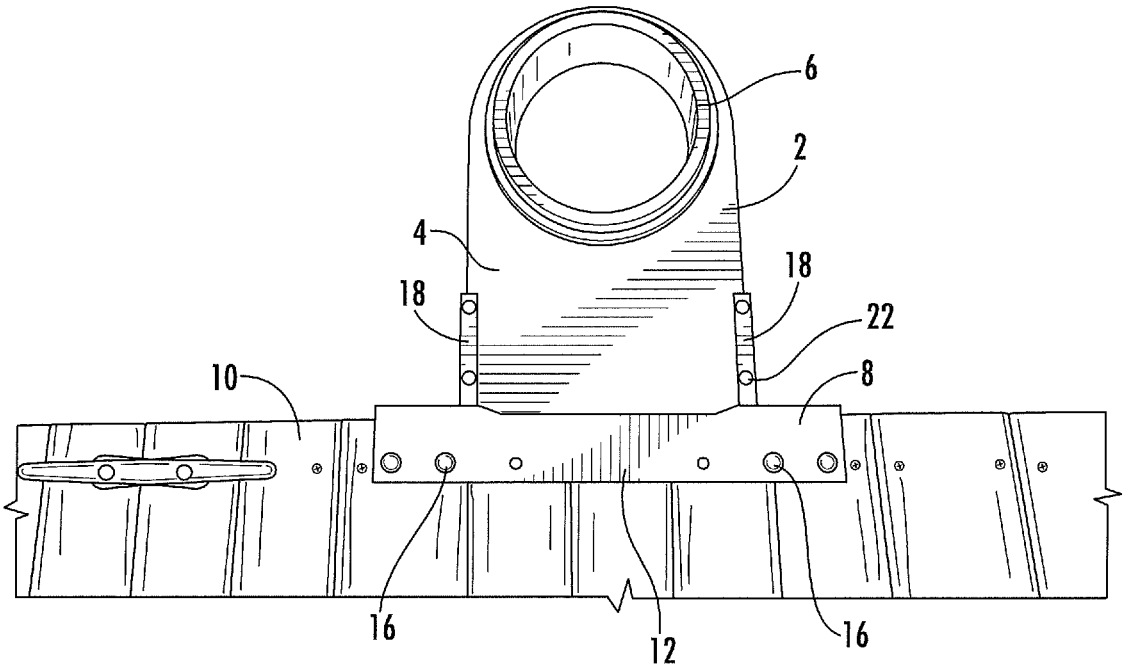
FIG. 1 is a top plan view showing a pile guide within an adjustable mounting, with the adjustable mounting fixed to a boat dock.

FIG. 1 shows a pile guide 2 according to the invention. The pile guide comprises a planar flange 4. The planar flange has a collar 6 positioned or formed therein. As shown in the drawings, and in use, an axis of the void of the collar extends vertically. The collar has an opening that is constructed and arranged to receive a pile that is driven into the earth. The pile extends upwardly from the earth and out of the top surface of the water. The pile extends through the opening in the collar of the pile guide. The pile guide is mounted to the dock. The pile and pile guide hold the floating dock in its horizontal position in the water, while usually permitting vertical movement of the floating dock.

The planar flange 4 of the pile guide is inserted into an adjustable mounting 8 according to the invention. The planar flange extends from one side of the collar 6. The planar flange minimally has a length capable of engaging the mounting brackets 18 that exceeds a diameter of the collar. The planar flange has a substantially flat upper surface and a substantially flat lower surface and wherein the substantially flat upper surface and the substantially flat lower surface are in the slidable relationship with the bracket.

The adjustable mounting 8 is fastened, such as by the use of bolts or screws, to a dock 10 that may be formed of wood or metal. The adjustable mounting may comprise a generally horizontal member 12 that meets a generally vertical member 14 at substantially a right angle so that a corner of the dock is received within the adjustable mounting. Fasteners, such as bolts or screws 16 may be inserted into the generally horizontal portion of the adjustable mounting. In some embodiments, bolts or screws are inserted into the vertical portion of the adjustable mounting.

Figure 4:
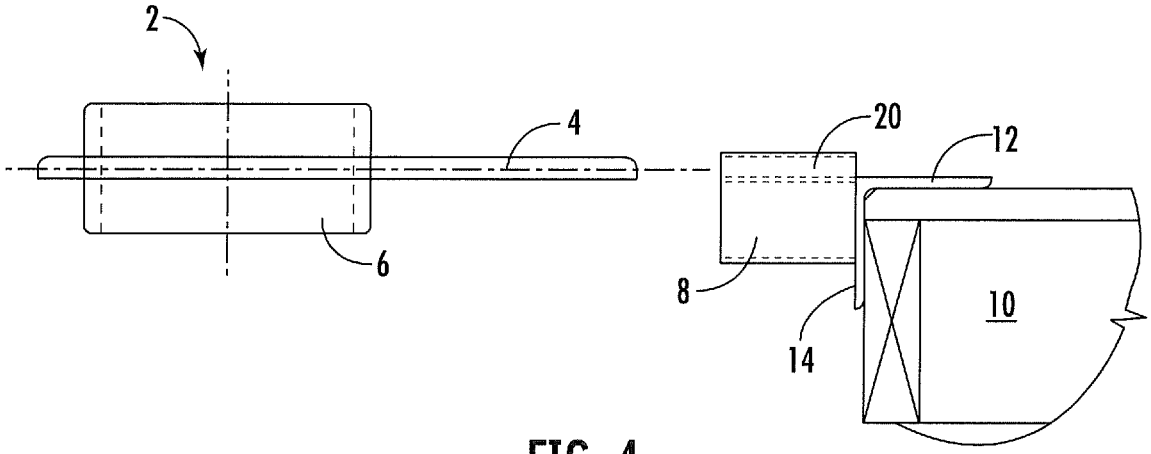
FIG. 4 is an elevation of the adjustable mounting affixed to a dock, with the pile guide exploded away from the adjustable mounting.
Figure 5:
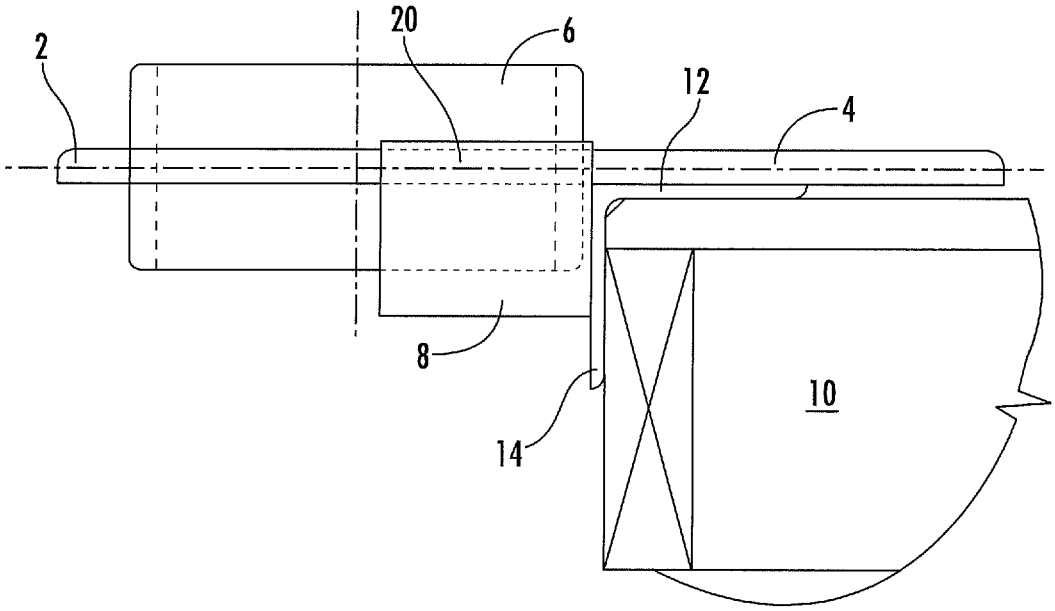
FIG. 5 is a side elevation of the adjustable mounting with the pile guide positioned within the adjustable mounting.
Figure 6:
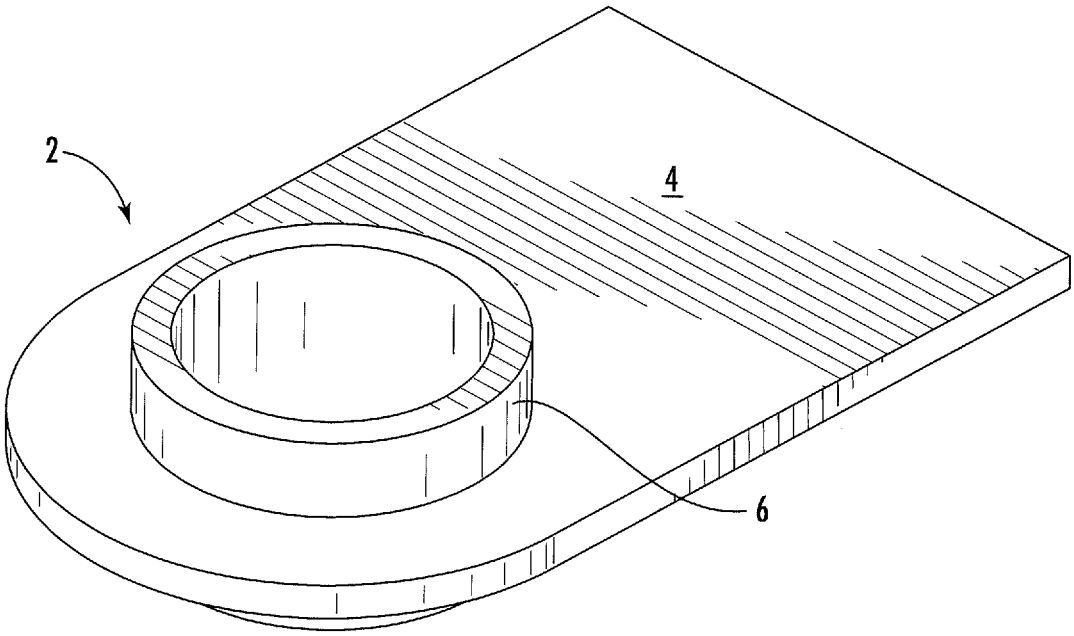
FIG. 6 is a perspective view of a pile guide useful with the invention.

In a preferred embodiment, opposing brackets 18 extend from the adjustable mounting opposite the vertical leg 14 from the dock 10. The opposing brackets may comprise opposing three sided guides 20 that receive the planar flange 4 of the pile guide. The guides may be generally in the shape of a "U" that is turned on its side, as shown in the drawing figures. FIG. 4. A first guide of the bracket comprises a member that extends generally vertically and a member that extends generally horizontally and, in use, above the member that generally extends generally horizontally, forming an opening in the first guide of the bracket. A second guide positioned on an opposing side of the bracket comprises a member that extends generally vertically and a member that extends generally horizontally and, in use, above the member of the opposing side that extends generally vertically, forming an opening in the second side of the bracket that opposes the opening in the first guide of the bracket. The planar flange of the pile guide is slidably retained between the opening in the first guide of the bracket and the opening in the second guide of the bracket. The brackets are formed as part of the adjustable mounting 8.

The guides 20 receive the planar flange of the pile guide. The planar flange 4 of the pile guide 2 slidably engages the opposing brackets 18 of the adjustable mounting 8. The pile guide may be positioned horizontally as desired relative to the dock and the adjustable mounting. A dock usually has multiple piles that engage pile guides which, in turn, engage the dock. Many times, the distance from the piles to the dock is not precise. The slidable engagement of the pile guide with the adjustable mounting compensates for the variation in distance of the individual piles from the dock.

Figure 2:
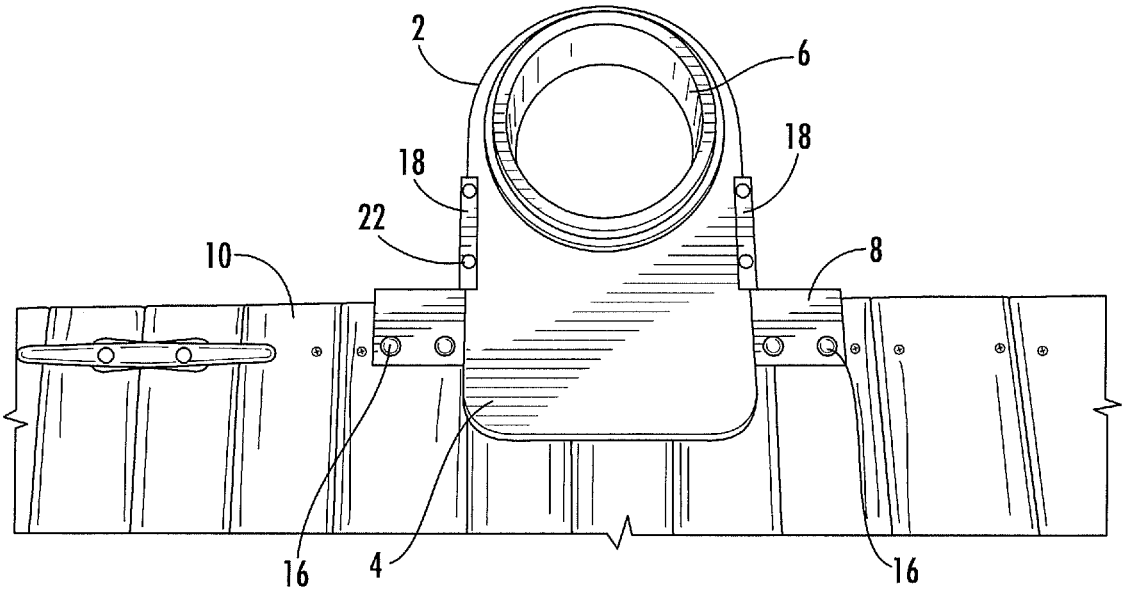
FIG. 2 is a top plan view showing a pile guide within an adjustable mounting in a different position from FIG. 1, with the adjustable mounting affixed to a boat dock.
Figure 3:
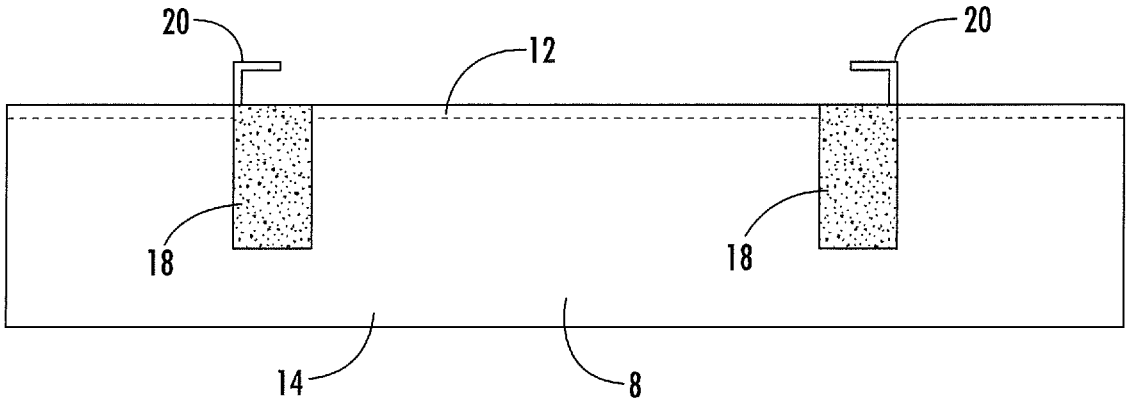
FIG. 3 is an elevation of the adjustable mounting.

The thickness and width of the flange is selected so that it is retained within the guides 20 of the adjustable mounting, but the pile guide can also slide within the opposing brackets 18 so that the opening of the collar 6 is positioned at a desired distance from the dock 10, as demonstrated by FIGS. 1 and 2. The length of the flange is also selected so as to provide adequate adjustability for positioning the collar relative to the dock.

In the present invention, since the pile guide slides within the adjustable mounting, and the distance between the piles and the dock varies from pile to pile, the variation in the distance can be accounted for by positioning the pile guide within the adjustable mounting as required. As shown in FIG. 1, the opening in the collar of the pile guide is further from the dock than in FIG. 2. The pile guide may then be fixed to the adjustable mounting in the preferred position by bolts or screws 22.

The pile guide 2 is preferred to be formed of high density polyethylene. High density polyethylene is impact resistant, has a low coefficient of friction and permits the planar flange 4 to slide easily within the opposing brackets 18 of the adjustable mounting. The pile guide may be formed of other impact resistant plastics, such as medium density polyethylene. The collar and the planar flange are preferred to be formed as unitary members of a single material. The adjustable mounting 8 construct is preferred to be formed of various materials. The adjustable mounting is formed of aluminum or stainless steel, which are corrosion resistant in water and saltwater. High density polyethylene is similarly corrosion resistant.

What is claimed:

1. A pile guide construct for floating docks, comprising:

a collar having a void therein, wherein an axis of the void of the collar extends vertically;

a planar flange extending from a side of the collar, and a bracket, the bracket comprising opposing guides constructed and arranged for receiving the planar flange of the pile guide therein, the planar flange having a length constructed to engage the bracket that exceeds a diameter of the collar, wherein the planar flange is in a slidable relationship with the bracket, and the bracket is constructed and arranged for mounting to a floating dock.

2. A pile guide construct for floating docks as described in claim 1, wherein the planar flange has a substantially flat upper surface and a substantially flat lower surface and wherein the substantially flat upper surface and the substantially flat lower surface are in the slidable relationship with the bracket.

3. A pile guide construct for floating docks as described in claim 1, wherein a first guide of the bracket comprises a member that extends generally vertically and a member that extends generally horizontally and, in use, above the member that generally extends generally horizontally, forming an opening in the first guide of the bracket, and a second guide on an opposing side of the bracket comprises a member that extends generally vertically and a member that extends generally horizontally and, in use, above the member of the opposing side that extends generally vertically, forming an opening in the second side of the bracket that opposes the opening in the first guide of the bracket, and wherein the planar flange of the pile guide is slidably retained between the opening in the first guide of the bracket and the opening in the second guide of the bracket.

4. A pile guide construct for floating docks as described in claim 1, wherein, in use, the collar extends above the planar flange and below the planar flange.

5. A pile guide construct for floating docks as described in claim 1, wherein, in use, the distance of the collar from the bracket is adjusted by sliding the planar flange within the bracket to a desired distance of the collar from the bracket, and fastening the planar flange to the bracket.

6. A pile guide construct for floating docks as described in claim 1, wherein the planar flange and the collar are formed as unitary members and the bracket is formed of metal.

7. A pile guide construct for floating docks as described in claim 1, wherein the planar flange and the collar are formed of polyethylene as unitary members and the bracket is formed of corrosion resistant metal.

8. A pile guide construct for floating docks as described in claim 1, wherein the bracket comprises a generally vertical member that extends below the opposing guides.

9. A pile guide construct for floating docks as described in claim 1, wherein each guide of the opposing guides has three sides, with an opening in each guide facing a center of the bracket.

10. A pile guide construct for floating docks as described in claim 1, wherein in use the planar flange is fastened to the bracket at a position determined by a desired position of the collar relative to the floating dock and by sliding the planar flange within the opposing guides to position the collar.

11. A pile guide construct for floating docks as described in claim 1, further comprising a generally horizontal member that is positioned below the opposing guides and connects a first guide of the opposing guides to a second guide of the opposing guides.

12. A pile guide construct for floating docks as described in claim 1, wherein the collar is formed as a cylinder.

* * * * *